US010710080B2

(12) United States Patent
Kaneko

(10) Patent No.: US 10,710,080 B2
(45) Date of Patent: Jul. 14, 2020

(54) CONTAINER FOR PCR

(71) Applicant: FUJIFILM Corporation, Tokyo (JP)

(72) Inventor: Yasuhisa Kaneko, Ashigarakami-gun (JP)

(73) Assignee: FUJIFILM Corporation, Minato-Ku, Tokyo (JP)

( * ) Notice: Subject to any disclaimer, the term of this patent is extended or adjusted under 35 U.S.C. 154(b) by 0 days.

(21) Appl. No.: 16/118,547

(22) Filed: Aug. 31, 2018

(65) Prior Publication Data

US 2018/0369804 A1 Dec. 27, 2018

Related U.S. Application Data

(63) Continuation of application No. PCT/JP2017/005127, filed on Feb. 13, 2017.

(30) Foreign Application Priority Data

Mar. 28, 2016 (JP) ..... 2016-064095

(51) Int. Cl.
*B01L 3/00* (2006.01)

(52) U.S. Cl.
CPC ..... *B01L 3/508* (2013.01); *B01L 3/50851* (2013.01); *B01L 2200/0647* (2013.01); *B01L 2200/16* (2013.01); *B01L 2300/0851* (2013.01); *B01L 2300/0858* (2013.01); *B01L 2300/12* (2013.01); *B01L 2300/161* (2013.01)

(58) Field of Classification Search
CPC ..... C12M 23/12; B01L 2300/0832; B01L 2300/0835; B01L 2300/0851; B01L 2300/0858
See application file for complete search history.

(56) References Cited

U.S. PATENT DOCUMENTS 5,180,555 A * 1/1993 Monget ..... B01L 3/508 356/246
6,340,589 B1 * 1/2002 Turner ..... B01L 3/5085 422/534

(Continued)

FOREIGN PATENT DOCUMENTS

JP 2001-509272 A 7/2001
JP 2004-097200 A 4/2004

(Continued)

OTHER PUBLICATIONS

International Search Report of PCT/JP2017/005127 dated May 16, 2017 [PCT/ISA/210].

(Continued)

*Primary Examiner* — William H. Beisner
(74) *Attorney, Agent, or Firm* — Sughrue Mion, PLLC

(57) ABSTRACT

Provided is a container for PCR enabling cell observation and a PCR treatment with a single container. In the container for PCR, a bottom surface 17*a* of an inside is flat, a shape of the bottom surface is a circular shape or a polygonal shape with four or more sides, a size of the bottom surface 17*a* is large so that a diameter L of an approximated circle circumscribing the bottom surface 17*a* is 0.05 mmϕ or more and 1 mmϕ or less, and an angle of an angle θ on a side surface side formed between a side surface 17*b* adjacent to the bottom surface 17*a* and the bottom surface 17*a* is 50° or more and 80° or less.

6 Claims, 5 Drawing Sheets

(56) References Cited

U.S. PATENT DOCUMENTS

| | | | | |
|---|---|---|---|---|
| 8,528,777 | B2 * | 9/2013 | Harder | C12Q 1/686 138/89 |
| 2003/0044969 | A1 * | 3/2003 | Shin | B01L 3/5085 435/288.4 |
| 2005/0042143 | A1 | 2/2005 | Watanabe et al. | |
| 2005/0170498 | A1 | 8/2005 | Dolley et al. | |
| 2007/0077648 | A1 | 4/2007 | Okamoto et al. | |
| 2011/0165609 | A1 | 7/2011 | Ramsing et al. | |
| 2013/0143272 | A1 | 6/2013 | Guo et al. | |
| 2015/0099644 | A1 * | 4/2015 | Chen | C12Q 1/6851 506/2 |

FOREIGN PATENT DOCUMENTS

| | | | |
|---|---|---|---|
| JP | 2005-249610 | A | 9/2005 |
| JP | 2007-097477 | A | 4/2007 |
| JP | 2007-526767 | A | 9/2007 |
| JP | 2009-204451 | A | 9/2009 |
| JP | 2010-032487 | A | 2/2010 |
| JP | 2010-531644 | A | 9/2010 |
| JP | 2014-518758 | A | 8/2014 |
| WO | 2005/011834 | A2 | 2/2005 |

OTHER PUBLICATIONS

Written Opinion of PCT/JP2017/005127 dated May 16, 2017 [PCT/ISA/237].

International Preliminary Report on Patentability issued in International Application No. PCT/JP2017/005127 dated Oct. 2, 2018 [PCT/IB/373].

Communication dated Aug. 1, 2019, from the Japanese Patent Office in counterpart Application No. 2018-508529.

Communication dated Feb. 25, 2020, from the Japanese Patent Office in Application No. 2018-508529.

* cited by examiner

CONTAINER FOR PCR

CROSS REFERENCE TO RELATED APPLICATIONS

This application is a Continuation of PCT International Application No. PCT/JP2017/005127 filed on Feb. 13, 2017, which claims priority under 35 U.S.C § 119(a) to Patent Application No. 2016-064095 filed in Japan on Mar. 28, 2016, all of which are hereby expressly incorporated by reference into the present application.

BACKGROUND OF THE INVENTION

1. Field of the Invention

The present invention relates to a container for PCR and particularly to a container for PCR which can be used for both cell photography and a PCR treatment.

2. Description of the Related Art

As a method for acquiring target cells from a plurality of cells, the target cells are separately acquired by flow cytometry. Flow cytometry refers to a technique in which cell are dispersed in a fluid, the fluid is caused to finely flow, the cells are optically analyzed, cells to be acquired are determined and separately acquired on the basis of the analysis results, and then the cells are analyzed.

In addition, an operation in which a plurality of cells is collectively added dropwise to a well slide, the cells are dropped into fine wells, the images of the cells are photographed by a microscopic inspection, target cells are specified by analyzing the obtained images, and then the specified target cells are suctioned using a capillary and moved to a well plate that is used for a polymerase chain reaction (PCR) treatment.

As the well plate that is used for the above-described microscopic inspection or PCR treatment, for example, the well plates described in JP2010-531644A, JP2007-526767A, JP2009-204451A, JP2014-518758A, and JP2001-509272A are exemplified.

SUMMARY OF THE INVENTION

The well plates described in JP2010-531644A, JP2007-526767A, JP2009-204451A, JP2014-518758A, and JP2001-509272A are well plates that are used for any one of image photographing or PCR, but are not well plates that can be used for both of the image photographing and the PCR treatment of cells. In addition, in this method, there are problems with a difficult operation, a long period of time required, and the high price of the capillary.

In addition, in the flow cytometry, the proportion of the target cells in the separately-acquired cells is approximately 70 to 80%, and thus it is not efficient to carry out an analysis or a pretreatment for an analysis on all of the cells separately acquired by the flow cytometry. Furthermore, the bottom surface of a PCR plate is not a flat structure, and thus it is difficult to match the focus to cells, and cells are not observed on the PCR plate.

The present invention has been made in consideration of the above-described circumstances, and an object of the present invention is to provide a container for PCR enabling both cell observation and a PCR treatment with a single container.

In order to achieve the above-described object, the present invention provides a container for PCR, in which a bottom surface of an inside is flat, a shape of the bottom surface is a circular shape or a polygonal shape with four or more sides, a size of the bottom surface is large so that a diameter of a circle approximated to a circle circumscribing the bottom surface is 0.05 mmϕ, or more and 1 mmϕ, or less, and an angle on a side surface side formed between a side surface adjacent to the bottom surface and the bottom surface is 50° or more and 80° or less.

According to the container for PCR of the present invention, the bottom surface of the inside of the container is set to be flat, and thus, in a case in which a cell is photographed using a microscope or the like, it becomes easy to match the focus to the entire cell, and it becomes possible to reliably photograph the cell. In addition, the shape of the bottom surface is set to a circular shape or a polygonal shape with four or more sides, and the size of the bottom surface is set in the above-described range, and thus it becomes possible to photograph the entire bottom surface in a single image with a preferred cell size by photographing the bottom surface using an object lens with an ordinarily-used magnification (five times or more and 63 times or less). Therefore, it is possible to efficiently carry out photographing and an image analysis.

In addition, the angle on the side surface side formed between the side surface adjacent to the bottom surface and the bottom surface is set to 50° or more, and thus it is possible to narrow a space formed by the bottom surface and the side surface. Therefore, it is possible to immerse the cell in a culture liquid with a small amount of the liquid, and it is possible to maintain the depth of the culture liquid in the container, and thus it is possible to prevent the drying of the cell. Meanwhile, "the angle on the side surface side formed between the side surface and the bottom surface" refers to, out of the angle between the bottom surface and the inner wall side of the container and the angle between the bottom surface and the side surface side being considered as the angle formed between the side surface and the bottom surface, the angle between the bottom surface and the side surface side.

Furthermore, the angle on the side surface side formed between the side surface adjacent to the bottom surface and the bottom surface is set to 80° or less, and thus it becomes easy to remove air bubbles in the culture liquid in the container for PCR, and it is possible to photograph a favorable image that is not affected by air bubbles.

In another aspect of the present invention, the side surface preferably has a plurality (two or more) of inclined surfaces having different angles with respect to the bottom surface.

In this aspect, in the case of the PCR container having, out of the plurality of inclined surfaces, at least one inclined surface other than the inclined surface in contact with the bottom surface which has an angle formed between the inclined surface and a parallel line to the bottom surface that is smaller than the angle on the side surface side formed between the side surface in contact with the bottom surface and the bottom surface, it becomes possible to widen an opening portion of the container, and it becomes easy to introduce a cell into the container.

In another aspect of the present invention, as the angle formed between the inclined surface not in contact with the bottom surface and the parallel line to the bottom surface, the angle on the side surface side is preferably 40° or more and 90° or less.

According to this aspect, the side surface has the plurality (two or more) of inclined surfaces, and the angle formed between the side surface not in contact with the bottom surface and the parallel line to the bottom surface is set to 40° or more, and thus it is possible to prevent the cell from remaining on the inclined surface which is the side surface instead of reaching the bottom surface in the case of introducing the cell into the container.

In another aspect of the present invention, as an angle formed between, out of the plurality of inclined surfaces, an inclined surface other than the inclined surface in contact with the bottom surface and a parallel line to the bottom surface, the angle on the side surface side preferably decreases from an opening portion toward the bottom surface of the container for PCR.

According to this aspect, the angles of the inclined surfaces which form the side surface and are not in contact with the bottom surface are set to gradually decrease toward the bottom surface, and thus there are no cases in which a cell remains on the inclined surfaces which are the side surface, and it is possible to facilitate the introduction of the cell into the bottom surface.

In another aspect of the present invention, an angle that is twice an angle formed between a line connecting a center of a circle approximated to a circle circumscribing the bottom surface and an end portion of the opening portion and a straight line perpendicular to the bottom surface is preferably 45° or less.

According to this aspect, the angle that is twice the angle formed between the line connecting the center of the circle approximated to the circle circumscribing the bottom surface and the end portion of the opening portion and the straight line perpendicular to the bottom surface is set to 45° or less, and thus it is possible to prevent the opening portion from widening and narrow a space in the case of disposing the container for PCR on the plate. In addition, the narrowing of the opening portion increases the angle of the inclination of the side surface, and thus it is possible to facilitate the guidance of a cell to the bottom surface.

In another aspect of the present invention, a thickness of the bottom surface is preferably 0.2 mm or more and 1 mm or less.

According to this aspect, the thickness of the bottom surface is set in the above-described range, and thus it is possible to match the focus of the lens to a cell during the photographing of the cell from the bottom surface side of the container for PCR and capture a favourable image. In a case in which the thickness of the bottom surface is 0.2 mm or more, images in which scratches, attached trash, or the like on the outside of the container are captured are not affected by the focal depth, and it becomes possible to capture only the image of the cell. In addition, in a case in which the thickness of the bottom surface is 1 mm or less, it becomes possible to bring the lens close to the cell, and thus it becomes possible to easily acquire an enlarged image of the cell.

In another aspect of the present invention, a transmittance of light having a wavelength of 350 nm or more and 800 nm or less is preferably 60% or more.

According to this aspect, the transmittance of a material that is used for the container for PCR with respect to light having the above-described wavelength is set to 60% or less, and thus it is possible to capture a favorable image.

In another aspect of the present invention, the material is preferably polypropylene or polystyrene.

In this aspect, the material that is used for the container for PCR is limited, and the use of polypropylene or polystyrene enables the obtainment of the transparency of the container and the photographing of a favorable image. In addition, in a PCR treatment, the temperature is applied during the treatment, and thus the use of the above-described material enables the ensuring of heat resistance.

In another aspect of the present invention, on an inside of the PCR container, a cell low-attachment treatment is preferably carried out.

The cell low-attachment treatment is a treatment that prevents cells, that is, protein, from attaching to the container and a treatment of coating an inside surface of the PCR container with a material that does not adsorb protein. According to this aspect, it is possible to reliably make the cell reach the bottom surface by preventing the cell from attaching to the inner wall of the container, and cell observation becomes possible.

According to the container for PCR of the present invention, it is possible to carry out the photographing (observation) of a cell and a PCR treatment in the same container. Therefore, an operation of moving the cell in the container after photographing an image is not required, and it is possible to efficiently analyze the cell. In addition, an expensive tool such as a capillary is not required, and it becomes possible to reduce the cost necessary for analyses.

DESCRIPTION OF THE PREFERRED EMBODIMENTS

Hereinafter, a container for PCR according to the present invention will be described according to the accompanying drawings. Meanwhile, in the present specification, numerical ranges expressed using "to" include numerical values before and after "to" as the lower limit value and the upper limit value.

<<Analysis Device>>

First, an analysis device to which a container for PCR according to the present embodiment is applied and which include a capturing device that captures images will be described.

Figure 1:
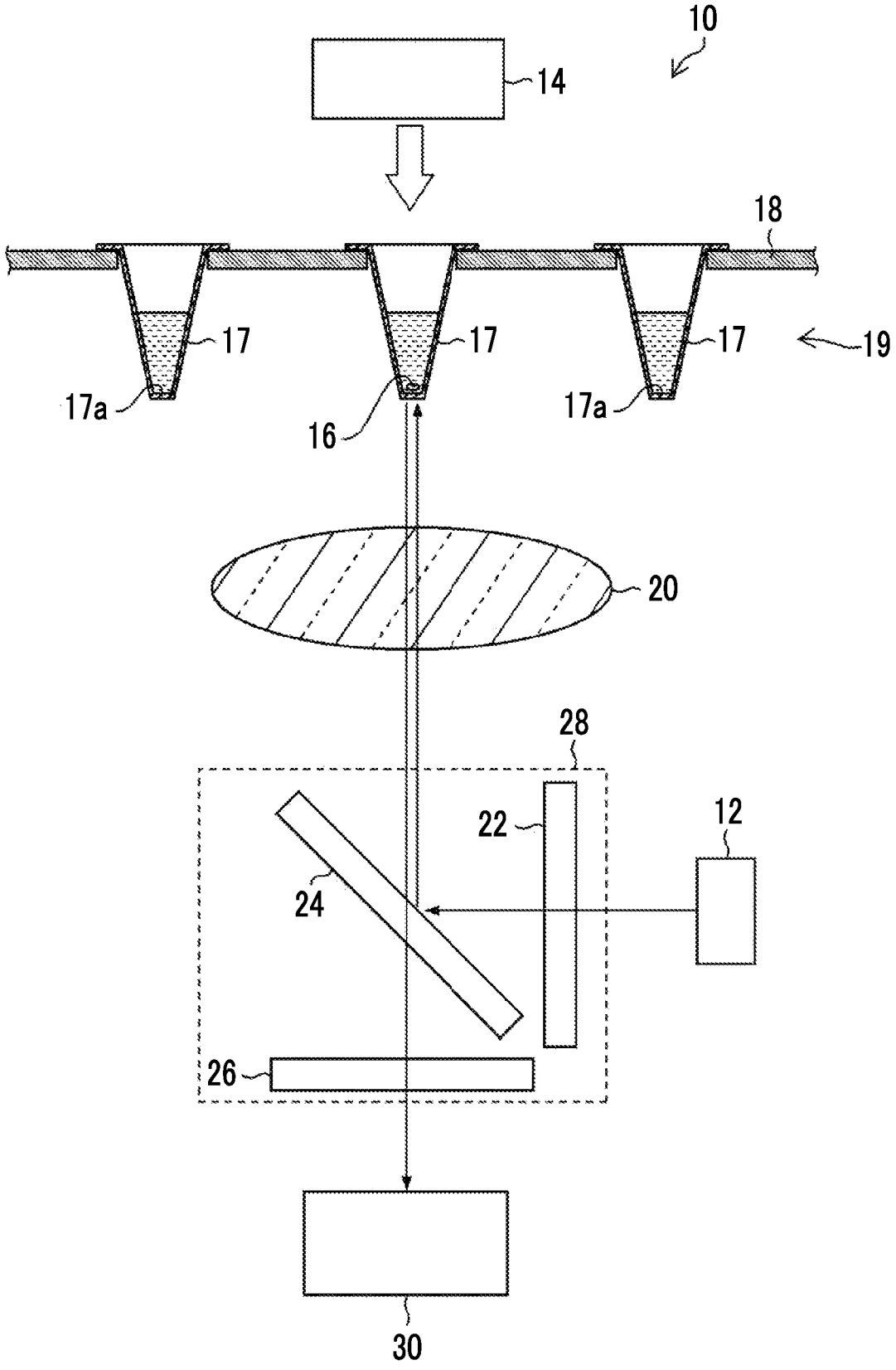
FIG. 1 is a schematic configurational view illustrating a configuration of a device that photographs cells.

FIG. 1 is a schematic configurational view illustrating the configuration of a device that photographs target cells separately acquired in the container for PCR or acquires optical information from the cells. A preferred aspect is an analysis device capable of acquiring the information of fluorescent emission from a fluorescent dye marked in cells separately acquired by an antigen-antibody reaction or the like or acquiring a light-transmissible image of cells using visible light.

An analysis device 10 illustrated in FIG. 1 includes an excitation light source device for fluorescence 12 that radiates light for measuring fluorescence emitted by cells which are a subject, a light source device for a bright field 14 that radiates light (visible light) for measuring transmitted light from the cells, a tray 19 made up of containers for PCR 17 that store cells 16 which act as a photographing subject and plates 18, a filter group (filter cube) 28 that holds a lens 20, an excitation filter 22, a dichroic mirror 24, and a fluorescent filter 26, and a capturing device 30 that photographs the fluorescence and the transmitted light from the cells 16.

As the excitation light source device for fluorescence 12, it is possible to use a high-pressure mercury lamp, a high-pressure xenon lamp, a light emitting diode (LED), a light amplification by stimulated emission of radiation (LASER), or the like. In the case of using these light sources, it becomes possible to reliably carry out highly accurate analyses by narrowing the wavelength range of radiated light that is radiated to the cells 16. In addition, as the excitation light source device for fluorescence 12, it is possible to use a tungsten lamp, a halogen lamp, a white LED, or the like. Even in a case in which these light sources are used, the excitation filter 22 transmits only the target wavelength, and thus it is possible to radiate light with the target wavelength to the cells 16. Meanwhile, as the light source device for a bright field 14, it is also possible to use the same light sources as the excitation light source device for fluorescence 12.

The tray 19 is made up of the plates 18 and the containers for PCR 17 of the present embodiment, and the container for PCR 17 holds the cell 16 which acts as an observation subject. The cell 16 is provided to the container for PCR 17 together with a cell culture liquid. The container for PCR 17 will be described below.

The lens 20 disperses the fluorescence emitted by the cells 16 due to light output from the excitation light source device for fluorescence 12 and the transmitted light which is light that has been output from the light source device for a bright field 14 and has passed through the cells 16. As the lens 20, it is possible to use a lens that is used for optical measurement.

The filter group 28 includes the excitation filter 22, the dichroic mirror 24, and the fluorescent filter 26. As a specific example of the above-described filter group 28, a filter cube is preferably used, and, for example, Zeiss filter Set 49 (DAPI) can be used. Out of light radiated from the excitation light source device for fluorescence 12, the excitation filter 22 only transmits light in a target wavelength range. The light transmitted by the excitation filter 22 is reflected in a direction toward the tray 19 in the dichroic mirror 24. Fluorescent emission from the cells 16 generated due to excitation light discharged from the excitation light source device for fluorescence 12 passes through the lens 20, the dichroic mirror 24, and the fluorescent filter 26 and is photographed by the capturing device 30. The fluorescence emitted from the excitation light has a wavelength range on a longer wavelength side than the excitation light, and thus it becomes possible to transmit only the fluorescent emission using the dichroic mirror 24. Furthermore, it becomes possible to cause the capturing device 30 to photograph an image on the basis of the information of only the fluorescent emission from the cells 16 using the fluorescent filter 26 that does not transmit the excitation light but transmits only the fluorescence. Therefore, it becomes possible to acquire images that are photographed by the capturing device 30 while preventing the images from being affected by the excitation light, and it is possible to improve the accuracy of inspection based on the fluorescent emission information.

In the fluorescence photographing using the light radiated from the excitation light source device for fluorescence 12, generally, immunostaining is carried out using a plurality of kinds of dyes in order to acquire a plurality of kinds of information regarding one cell depending on the inspection purpose of cells. In this case, optical information of different wavelengths can be independently acquired by photographing fluorescence that is generated from the plurality of kinds of dyes in the immunostained cells using a filter group having transmission characteristics or reflection characteristics appropriate to the fluorescent wavelengths of the respective dyes. Meanwhile, in the case of photographing the transmitted light from the cells 16 using the light source device for a bright field 14, the transmitted light is photographed in a state in which the filter group 28 is removed. In such a case, it is possible to photograph the transmitted light using the capturing device 30.

The capturing device 30 is not particularly limited as long as the fluorescence or the transmitted light from the cells 16 separately acquired in the containers for PCR 17 in the tray 19 can be photographed, and, for example, a charge-coupled device (CCD) camera can be used.

As a method for separately acquiring cells in the containers for PCR, it is possible to carry out, for example, flow cytometry. In addition, a plurality of cells can be separately acquired in the containers for PCR by collectively adding the cells dropwise onto the tray in which the containers for PCR and plates are integrated together and dropping the cells into the containers for PCR by centrifugally separating (100 rpm, one minute) the cells or leaving the cells to stand. In a case in which the containers for PCR and plates are integrally formed, it is preferable to provide cut introduction mechanisms such as grooves, cutout lines, or printed lines on the plates. It becomes possible to separately treat the containers for PCR by cutting the plates along the cut introduction mechanisms.

<<Container for PCR>>

Figure 2:
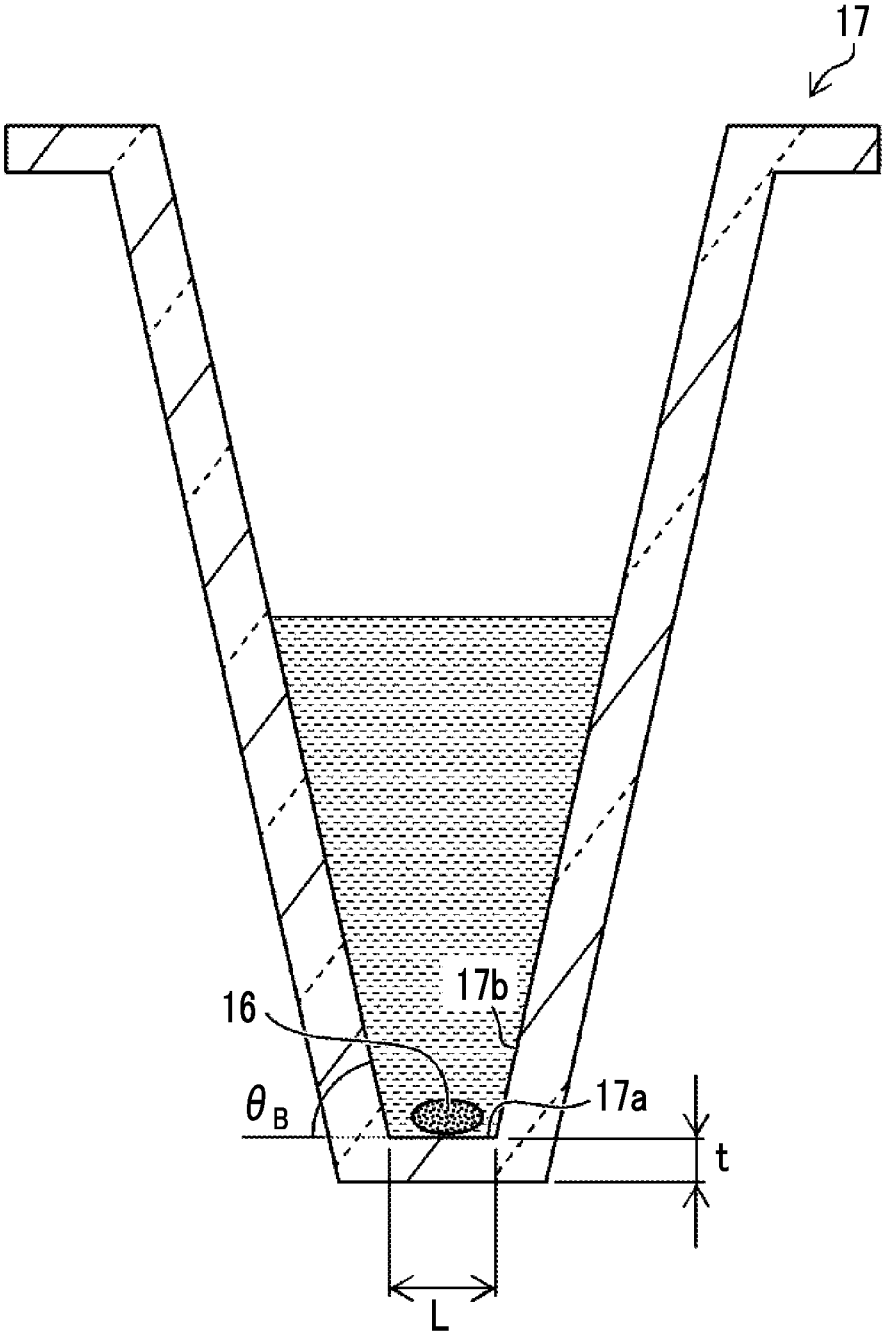
FIG. 2 is a cross-sectional view illustrating a shape of a container for PCR.

FIG. 2 is a cross-sectional view illustrating the shape of the container for PCR 17 which is used in the present embodiment. In the analysis device 10 illustrated in FIG. 1, the excitation light is radiated from a rear surface side of the container for PCR 17, and the fluorescent emission occurs from the cell that emits light due to the excitation light that has been transmitted by the container for PCR 17. In order to receive the fluorescence including the information of the cell, the material of the container for PCR 17 needs to be a material satisfying conditions that the material is transparent with respect to this fluorescence, does not emit fluorescence for itself, does not scatter the fluorescence, is capable of withstanding a temperature cycle that is carried out during PCR, and the like. In addition, in order to photograph the cell 16, a bottom surface 17*a* of an inside of the container for PCR 17 has a flat shape. In a case in which the bottom surface 17*a* of the container for PCR 17 is set to be flat, it becomes possible to match the focus to the cell 16, and it is possible to accurately analyze the image of the cell 16 present on the bottom surface 17*a*.

In addition, the shape of the bottom surface 17*a* is a circular shape or a polygonal shape with four or more sides. In addition, the size of the bottom surface 17*a* is large so that a diameter L of a circle approximated to a circle circumscribing the bottom surface 17*a* is 0.05 mmϕ, or more and 1 mmϕ, or less and more preferably 0.2 mmϕ, or more and 0.5 mmϕ, or less. Meanwhile, FIG. 2 illustrates the bottom surface 17*a* having a circular shape. In a case in which the shape and size of the bottom surface 17*a* are set to the above-described shape and size, and furthermore, an object lens having a magnification of five times or more and 63 times or less is used, it is possible to photograph the entire bottom surface 17*a* in a single view (one-shot photographing) with a preferred cell image size. In order to acquire a plurality of kinds of information regarding one cell depending on the inspection purpose of cells, generally, it is preferable to carry out immunostaining using a plurality of kinds of dyes. Therefore, the capturing of the cell 16 includes obtaining the fluorescence information from the respective dyes in the fluorescent images and bright field photographing images, and after the photographing, it is possible to analyze the cell by overlapping individual images.

Figure 3:
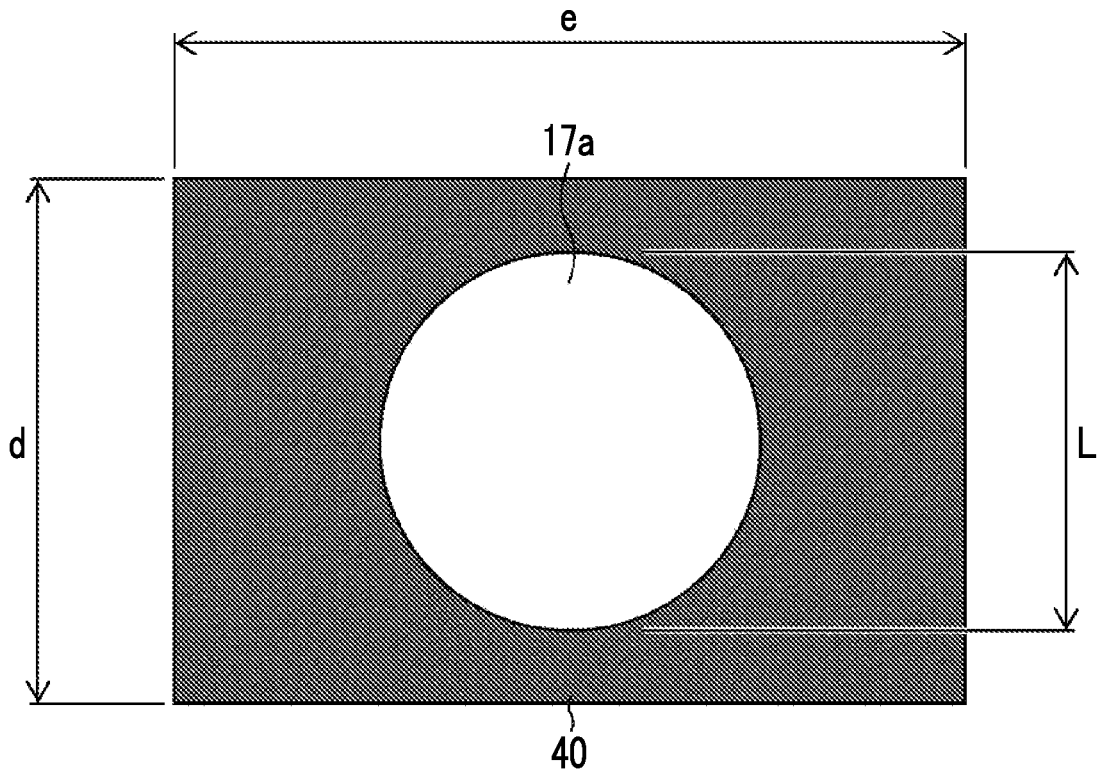
FIG. 3 is a view illustrating a relationship between an image being captured and a size of a bottom surface of the container for PCR.

FIG. 3 is a view illustrating a relationship between an image-photographing region 40 being captured by a microscope and the flat bottom surface of the inside of the container for PCR. The size of the bottom surface is preferably set so that the diameter L of the bottom surface is shorter than the length of a short side d out of two intersecting sides of the image-photographing region 40, that is, a long side e and the short side d and is ½ or more of the length of the short side d. In a case in which the length of the diameter L of the bottom surface is set to d>L>d/2, it becomes possible to photograph the flat bottom surface 17*a* of the inside of the container for PCR in which the cell is stored in the image-photographing region 40 with a preferred size of a cell image and the cell in a single view. The size of the image-photographing region 40 is determined depending on the magnification of the object lens of the microscope and a photographing camera. In a case in which an ordinarily-used camera is used, for example, an object lens having a magnification of 20 times is used, it is possible to capture the bottom surface 17*a* with a single sheet in the image-photographing region 40 by setting the diameter L of the bottom surface to 0.4 mmϕ. In addition, in a case in which the object lens has magnifications of 40 times, 63 times, and five times respectively, it is possible to capture the bottom surface 17*a* in a single image by setting the diameter L of the bottom surface to 0.2 mmϕ, 0.1 mmϕ, and 1 mmϕ respectively. The magnification at which the cell is observed is preferably a high magnification; however, as the magnification increases, the accuracy of image analyses begins to be affected the unevenness or the like of the bottom surface of the container for PCR, and thus the magnification of the object lens is preferably 20 times.

In FIG. 2, a side surface 17*b* in contact with the bottom surface 17*a* has an angle $\theta_B$ on a side surface side, which is an angle formed between the bottom surface 17*a* and the side surface 17*b*, of 50° or more and 80° or less. In a case in which the angle of the angle $\theta_B$ formed between the bottom surface 17*a* and the side surface 17*b* is set to 80° or less, it is possible to facilitate the removal of air bubbles in the culture liquid. In addition, in a case in which the angle of the angle $\theta_B$ is set to 50° or more, and the size of the bottom surface is set so that the diameter L of the circle approximated to the circumscribing circle reaches 0.05 mmϕ or more and 1 mmϕ or less, it is possible to narrow a space formed by the bottom surface 17*a* and the side surface 17*b*, and it is possible to immerse the cell 16 in the culture liquid with a small amount of the culture liquid. Furthermore, it is possible to prevent the drying of the culture liquid and the cell 16, and it is possible to prevent light from being refracted due to the meniscus of the liquid surface of the culture liquid and prevent the refraction from affecting image analyses by ensuring the depth of the culture liquid. The angle of the angle $\theta_B$ is more preferably set to 55° or more and 70° or less.

The thickness of the bottom surface 17*a* of the container for PCR 17 is preferably set to 0.2 mm or more and 1 mm or less. As illustrated in FIG. 1, the cell 16 is preferably photographed from a bottom surface 17*a* side of the container for PCR 17. In a case in which the thickness of the bottom surface 17*a* is 1 mm or less, it becomes possible for the lens 20 to come close to the cell 16, which is preferable. In addition, in a case in which the thickness is 0.2 mm or more, the focus of scratches, attached trash or contaminants, or the like on the outside of the container for PCR 17 deviates from the focal depth and does not affect images to be captured, and it becomes possible to capture only the image of the cell, which is preferable. The thickness t of the bottom surface 17*a* is still more preferably 0.3 mm or more and 0.5 mm or less and most preferably 0.4 mm.

As the material of the container for PCR 17, a material that easily transmits light during the capturing of images is preferably used, and specifically, a material selected from polypropylene or polystyrene can be used. In addition, the container for PCR for which the above-described material is used also has excellent heat resistance and is capable of carrying out a PCR treatment without being deteriorated even in the case of being applied to a PCR thermal cycler. For the container for PCR manufactured using the above-described material, the transmittance of light having a wavelength of 350 nm or more and 800 nm or less is preferably 60% or more, more preferably 70% or more, and still more preferably 80% or more. In the present invention, the "transmittance" is a value obtained by dividing transmitted light by incident light (transmittance=transmitted light/incident light), and, for example, in a case in which the number of incident light rays is 100 and the number of transmitted light rays is 60, the transmittance is computed as 60%.

The shape of the outside of the container for PCR 17 is preferably a shape enabling the container for PCR to be mounted in a device that carries out a PCR treatment, a PCR thermal cycler. In a case in which the shape of the outside of the container for PCR is matched to that of a device that carries out a PCR treatment, it is possible to carry out a PCR treatment using the container for PCR in which an image has been captured. In a case in which the shape is set so that the container for PCR can be mounted in a PCR thermal cycler, the gap between the device that carries out a PCR treatment and the outer form of the container for PCR 17 is preferably narrow. In a case in which the gap with the container for PCR 17 is set to be small, it is possible to efficiently apply the temperature to the container for PCR 17. In addition, in order to efficiently apply the temperature during the PCR treatment, the outside shape and the inside shape of the container for PCR are preferably substantially identical to each other (similar shapes), and furthermore, the thickness of the side surface is more preferably uniform from the bottom surface throughout an opening portion. In a case in which the thickness is set to be uniform, it becomes possible to accurately control the PCR treatment by efficiently and uniformly transferring heat to the cell and the culture liquid in the container for PCR.

In addition, on the inside of the container for PCR 17, it is preferable to carry out a cell low-attachment treatment. The cell low-attachment treatment is a treatment that prevents cells, that is, protein from attaching to the inside of the container for PCR 17 and a treatment of coating the surface with a material that does not adsorb protein. A hydrophobic interaction with which a hydrophobic group on the surface of a resin that is a material of the container for PCR 17 and a hydrophobic group in protein bond to each other is considered as a main cause of the adsorption of protein to the inside of the container for PCR 17. Therefore, the cell low-attachment treatment is enabled by coating the surface with a material having a hydrophilic group.

As a material that is used in the cell low-attachment treatment, it is possible to use a material having a hydrophilic group such as a polymer including a phosphocholine group (for example, LIPIDURE (registered trademark) (another name: MPC (2-methacryloyloxyethylphosphorylcholine) polymer) (manufactured by NOF Corporation)), polyvinylpyrrolidone, polyethylene glycol, polyvinyl alcohol (PVA) hydrogel, or Bovine serum albumin (BSA). As a coating method, it is possible to coat the surface by dipping the surface in a dispersion liquid obtained by dispersing the above-described material in a solvent and then drying the surface.

In a case in which the cell low-attachment treatment is carried out on the inside of the container for PCR 17, it is possible to prevent the cell from attaching to the inner wall of the container for PCR 17, reliably make the cell reach the bottom surface 17*a*, and enable the observation of the cell.

Figure 4:
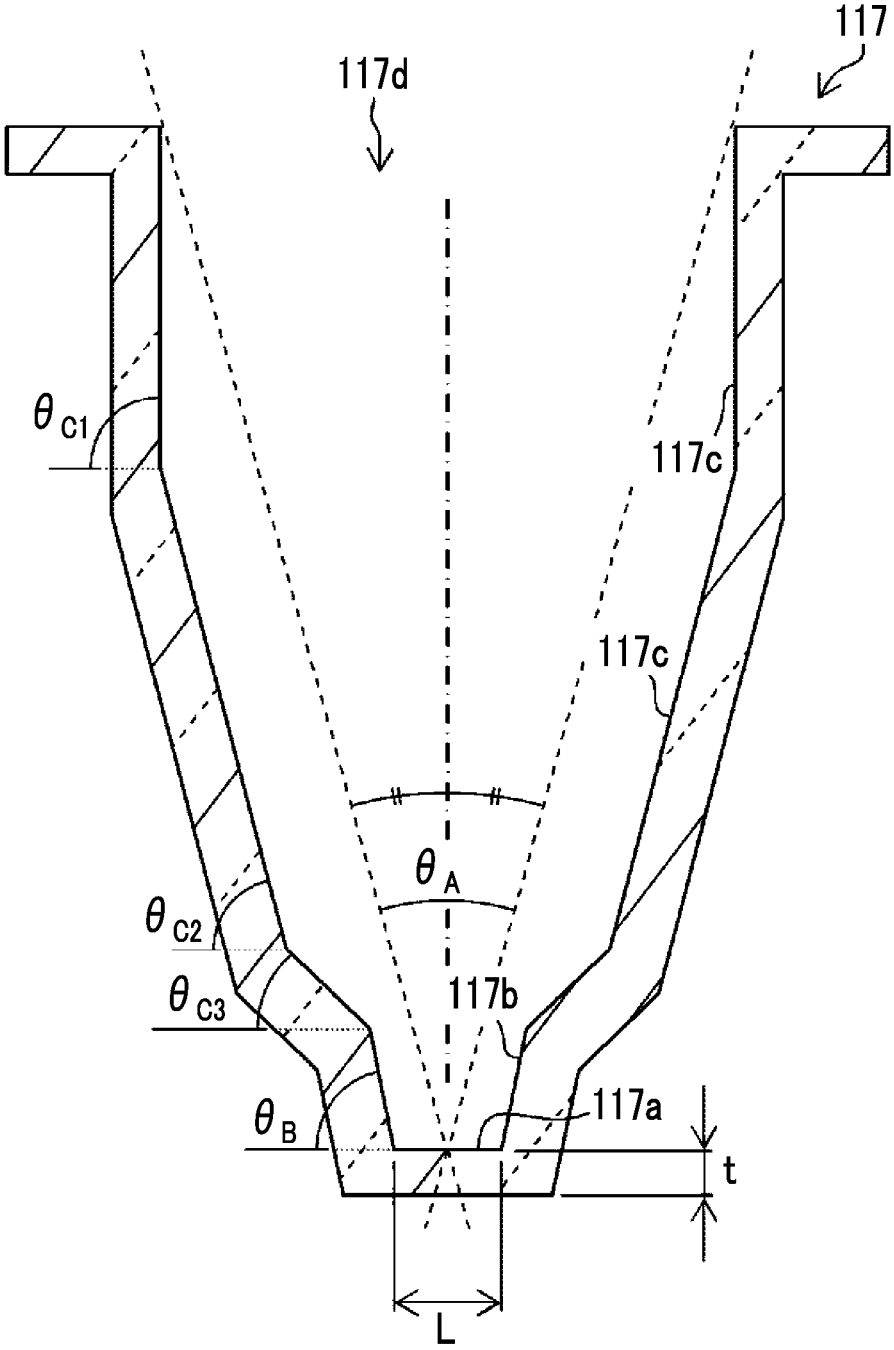
FIG. 4 is a cross-sectional view illustrating a shape of a container for PCR of another embodiment.

FIG. 4 is a cross-sectional view illustrating the shape of a container for PCR 117 of another embodiment. As illustrated in FIG. 4, the side surface bends multiple times and can also be formed of two or more inclined surfaces. In a case in which the side surface bends multiple times, side surfaces 117*c* other than a side surface 117*b* in contact with a bottom surface 117*a* preferably have an angle of angles $\theta_{C1}$ to $\theta_{C3}$ on the side surface side, as the angle formed between each of the side surfaces 117*c* and a parallel line to the bottom surface 117*a*, of 40° or more and 90° or less. In a case in which the angle is 40° or more, there are no cases in which a cell remains on the inclined surface of the side surface 117*c*, and it becomes possible to reliably store the cell on the bottom surface. In addition, in a case in which the angle is 40° or more, it becomes possible to narrow an opening portion 117*d* of the container for PCR 117, and it becomes possible to store a plurality of containers for PCR in a narrow space of the tray 19, which is preferable.

Furthermore, in a case in which the side surface bends multiple times, it is preferable to set the angles $\theta_{C1}$ to $\theta_{C3}$ to gradually decrease from the opening portion 117*d* toward the bottom surface 117*a* except for the side surface 117*b* in contact with the bottom surface 117*a*, that is, $\theta_{C1}>\theta_{C2}>\theta_{C3}$. In the case of providing the above-described configuration, it becomes possible to facilitate the guidance of a cell separately acquired in the container for PCR 117 to the bottom surface 17*a*. In addition, in a case in which the second angle from the bottom surface of the container for PCR 117 (the angle $\theta_{C3}$ in FIG. 4) is set to be small, it becomes possible to facilitate the adjustment of the amount of the culture liquid in the container for PCR 117. In a case in which the culture liquid in the container for PCR 117 is removed using a pipette or the like, it become possible to retain the culture liquid only in a space close to the bottom surface of the container for PCR which is formed by the bottom surface 117*a* and the side surface 117*b* by removing the culture liquid with the pipette in contact with the side surface 117*c*. The angles of the angles $\theta_{C1}$ to $\theta_{C3}$ can be set to, for example, $\theta_{C1}=90°$, $\theta_{C2}=75°$, and $\theta_{C3}=45°$ in FIG. 4.

In addition, in terms of an angle of an angle $\theta_A$ which is an angle that is twice an angle formed between a line connecting the center of the bottom surface 117*a* (the center of the circle approximated to the circumscribing circle) and an end portion of the opening portion 117*d* and a straight line perpendicular to the bottom surface, the widest angle is preferably less than 45°. In a case in which the angle of the angle $\theta_A$ is set to less than 45°, it becomes possible to prevent the opening portion 117*d* of the container for PCR 117 from widening and decrease the space of the tray 19.

Figure 5:
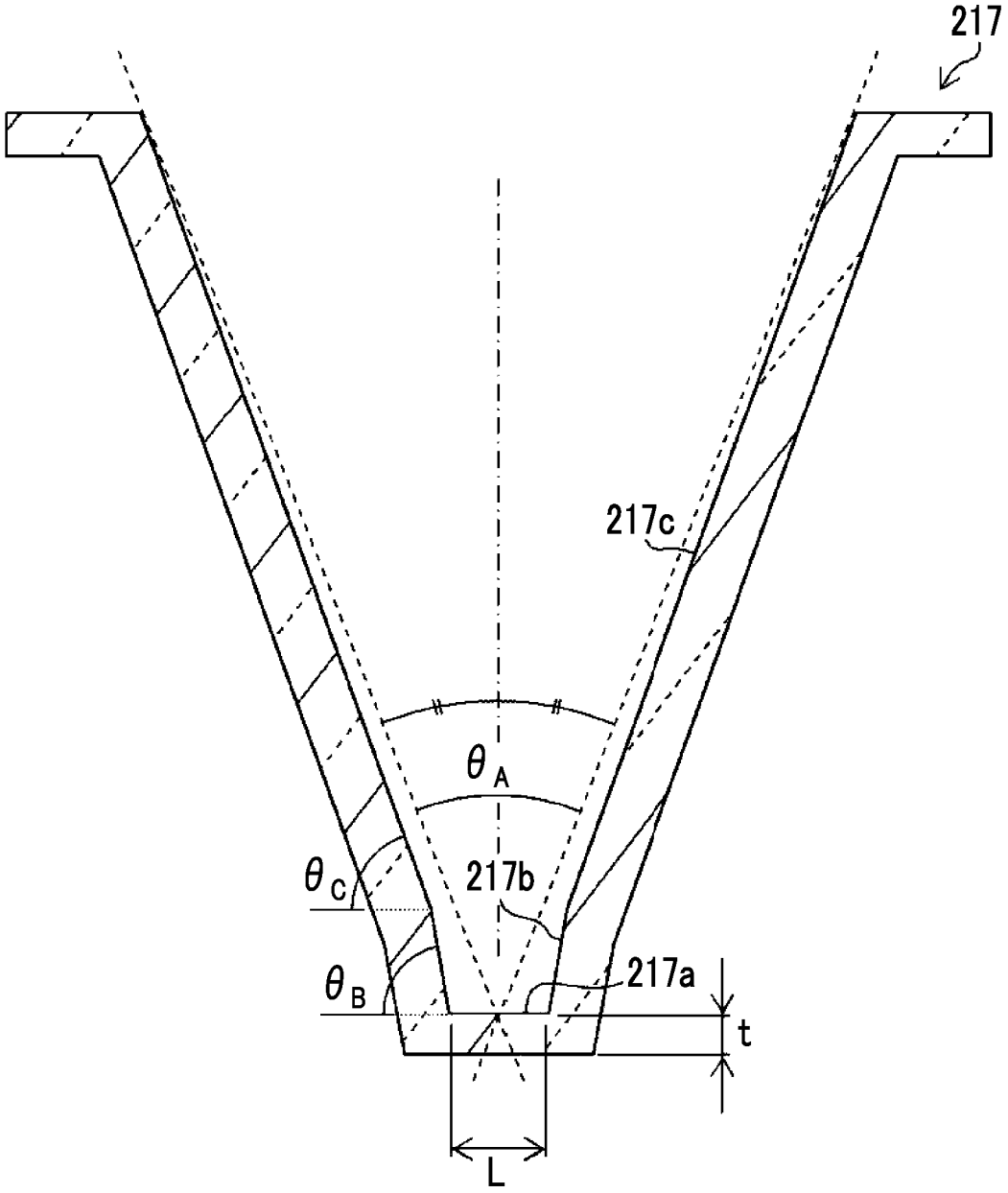
FIG. 5 is a cross-sectional view illustrating a shape of a container for PCR of still another embodiment.

FIG. 5 is a cross-sectional view illustrating the shape of a container for PCR 217 of still another embodiment. This container for PCR is different from the container for PCR 117 of the embodiment illustrated in FIG. 4 in terms of the number of times of bending of the side surface. The number of times of bending of the side surface is not limited, and it is possible to form the side surface with two inclined surfaces, that is, a side surface 217*b* in contact with a bottom surface 217*a* and a side surface 217*c* that bends at an angle $\theta_C$ which is an angle different from an angle $\theta_B$.

EXPLANATION OF REFERENCES

10: analysis device
12: excitation light source for fluorescence
14: light source device for bright field
16: cell
17, 117, 217: container for PCR
17*a*, 117*a*, 217*a*: bottom surface
17*b*, 117*b*, 117*c*, 217*b*, 217*c*: side surface
117*d*: opening portion
18: plate
19: tray
20: lens
22: excitation filter
24: dichroic mirror
26: fluorescent filter
28: filter group (filter cube)
30: capturing device
40: image-photographing region

What is claimed is:

1. A container for PCR, wherein a bottom surface of an inside is flat, a shape of the bottom surface is a circular shape or a polygonal shape with four or more sides, a size of the bottom surface is large so that a diameter of a circle approximated to a circle circumscribing the bottom surface is 0.05 mmϕ or more and 1 mmϕ or less, and an angle on a side surface side formed between a side surface adjacent to the bottom surface and the bottom surface is 50° or more and 80° or less, wherein the side surface has a plurality of inclined surfaces other than an inclined surface in contact with the bottom surface having different angles with respect to the bottom surface, wherein, as angles formed between the plurality of inclined surfaces and a parallel line to the bottom surface, the angles on the side surface side are 40° or more and 90° or less, and wherein the angles on the side surface side of the plurality of inclined surfaces gradually decrease from an opening portion toward the bottom surface of the container for PCR.

2. The container for PCR according to claim 1, wherein an angle that is twice an angle formed between a line connecting a center of the circle approximated to the circle circumscribing the bottom surface and an end portion of an opening portion of the container for PCR and a straight line perpendicular to the bottom surface is 45° or less.

3. The container for PCR according to claim 1, wherein a thickness of the bottom surface is 0.2 mm or more and 1 mm or less.

4. The container for PCR according to claim 1, wherein a transmittance of light having a wavelength of 350 nm or more and 800 nm or less is 60% or more.

5. The container for PCR according to claim 1, wherein a material is polypropylene or polystyrene.

6. The PCR container according to claim 1, wherein the container for PCR have an inner surface layer composed of a material having a hydrophilic group.

* * * * *